United States Patent [19]

Stager

[11] 4,122,554

[45] Oct. 31, 1978

[54] DISPOSABLE COSMETIC GLOVE

[76] Inventor: Phyllis H. Stager, 7619 Chattington, Dallas, Tex. 75240

[21] Appl. No.: 782,004

[22] Filed: Mar. 28, 1977

[51] Int. Cl.[2] ..... A41D 19/02

[52] U.S. Cl. ..... 2/164

[58] Field of Search ..... 2/164, 167; 128/260, 128/268

[56] References Cited

U.S. PATENT DOCUMENTS

| | | | |
|---|---|---|---|
| 2,501,565 | 3/1950 | Halley | 2/167 |
| 2,653,601 | 9/1953 | Morrison | 128/260 |
| 3,235,881 | 2/1966 | Chisholm | 2/167 |
| 3,342,182 | 9/1967 | Charos | 2/164 |
| 3,866,245 | 2/1975 | Sutherland | 2/167 |

*Primary Examiner*—Doris L. Troutman

*Attorney, Agent, or Firm*—Hubbard, Thurman, Turner, Tucker & Glaser

[57] ABSTRACT

A disposable cosmetic glove is disclosed which includes an outer glove shell of lotion impervious material and an inner glove lining of lotion absorbent material. The inner glove lining is preferably uniformly impregnated with a cosmetic lotion, however, the glove may be provided with a lining which is not impregnated thereby permitting a person to inject a lotion of personal choice into the insert prior to use. In a preferred embodiment, the shell is formed of superposed layers of thermoplastic material and the lining is formed of superposed layers of fiber material. The shell and lining are sealed together by folding one of the thermoplastic layers around superposed edge portions of the fiber layers and overlapping the other thermoplastic layer. The fiber layer edge portions are preferably bonded to the thermoplastic edge portions by an adhesive deposit, and the overlapping thermoplastic edge portions are thermally fused together.

2 Claims, 2 Drawing Figures

DISPOSABLE COSMETIC GLOVE

BACKGROUND OF THE INVENTION

1. Field of the Invention

The present invention relates generally to the art of cosmetic appliances, and in particular, to a disposable hand care glove.

2. Description of the Prior Art

Lotions, creams, oils and the like are commonly used for smoothing, strengthening and generally beautifying the skin of a person's hands. These cosmetic preparations are usually applied simply by rubbing the lotion or cream directly onto the hands. The soothing, therapeutic effect is best obtained by saturating the skin for a considerable length of time to permit the lotion or cream to penetrate and soften the skin to the desired depth. A one-time application of lotion to the skin such as by manually rubbing the lotion into the skin cannot provide the desired depth of penetration and continued exposure of the lotion to the skin sice the lotion is quickly rubbed off of the skin when brought into contact with articles such as clothing or bed linen.

The prior art discloses a number of articles of apparel and applicator pads which conserve the cosmetic lotion while the skin is being treated. For example, U.S. Pat. No. 2,501,565 discloses a hand mitten impregnated with a cream such as lanolin and lemon oil; U.S. Pat. No. 2,916,036 discloses a rubber glove, the lining of which is impregnated with an unguent material such as lanolin; other patents disclosing gloves impregnated with creams include U.S. Pat. Nos. 3,116,732; 3,342,182; 3,298,368; 3,384,083; and 3,499,446. Other articles of apparel impregnated with various therapeutic cream or oil formulations are disclosed in U.S. Pat. Nos. 3,354,884 (facial mask); 2,664,087 (foot slipper); and 3,489,884 (diaper).

Patents disclosing applicator pads or cloths or paper impregnated with creams or cream-like materials include U.S. Pat. Nos. 1,836,833; 2,495,066; 2,999,265; 3,624,224; and 3,896,807.

The conventional cosmetic appliances are typically formed by a reusable outer glove which may have lotion applied directly to its interior or which may carry a lotion saturated insert which may be removed from the outer glove after use. Prior to using the glove again, its interior must be cleaned or otherwise sanitized. A requirement that the outer glove shell be cleaned or sanitized after use is a serious drawback because of the inconvenience involved.

SUMMARY OF THE INVENTION

The principle object of the invention is the provision of a disposable cosmetic glove which simplifies the application of a cosmetic lotion or cream to a person's hands which is convenient to use, sanitary, and which aids in promoting the absorption of the lotion or cream or cosmetic preparation into the skin for an extended period of time while conserving the lotion or cream during the treatment. These features are provided by a disposable cosmetic glove which comprises generally an outer glove shell which is characterized by superposed first and second layers of lotion impervious material and an inner glove lining formed by superposed first and second lotion absorbent layers. The inner glove lining is preferably uniformly impregnated with a cosmetic lotion; however, the glove may be provided with a lining which is not impregnated thereby permitting a person to inject a lotion of personal choice into the insert prior to use. The shell and lining layers are sealed together along the marginal edge of the glove thereby defining a central hand receiving chamber. In a preferred embodiment, one of the thermoplastic layers is folded around the superposed marginal edge portions of the fiber layers and overlaps the other thermoplastic layer. The superposed marginal edge portions of the fiber layers are preferably bonded to the overlapping thermoplastic layers by means of an adhesive deposit, and the overlapping thermoplastic edge portions are thermally fused together. The outer and inner layers may be constructed and joined by other techniques without departing from the basic concept of a disposable cosmetic glove.

Because of the simple construction of the glove, it is convenient to use and is relatively inexpensive so that it can be readily disposed of after each treatment. Because it is completely disposable, the sanitation problems associated with reusable cosmetic gloves are thereby avoided. In addition to conserving the hand treatment lotion or other cosmetic preparation, the disposable glove also provides protection against staining or in any way soiling clothing or other materials such as bed linen which might otherwise be soiled if a lotion or cosmetic preparation were used without a covering.

BRIEF DESCRIPTION OF THE DRAWING

The novel features which characterize the invention are set forth in the appended claims. The invention together with additional objects and advantages thereof will be best understood from the following description of a preferred embodiment when read in connection with the accompanying drawing, in which:

DETAILED DESCRIPTION

Figure 1:
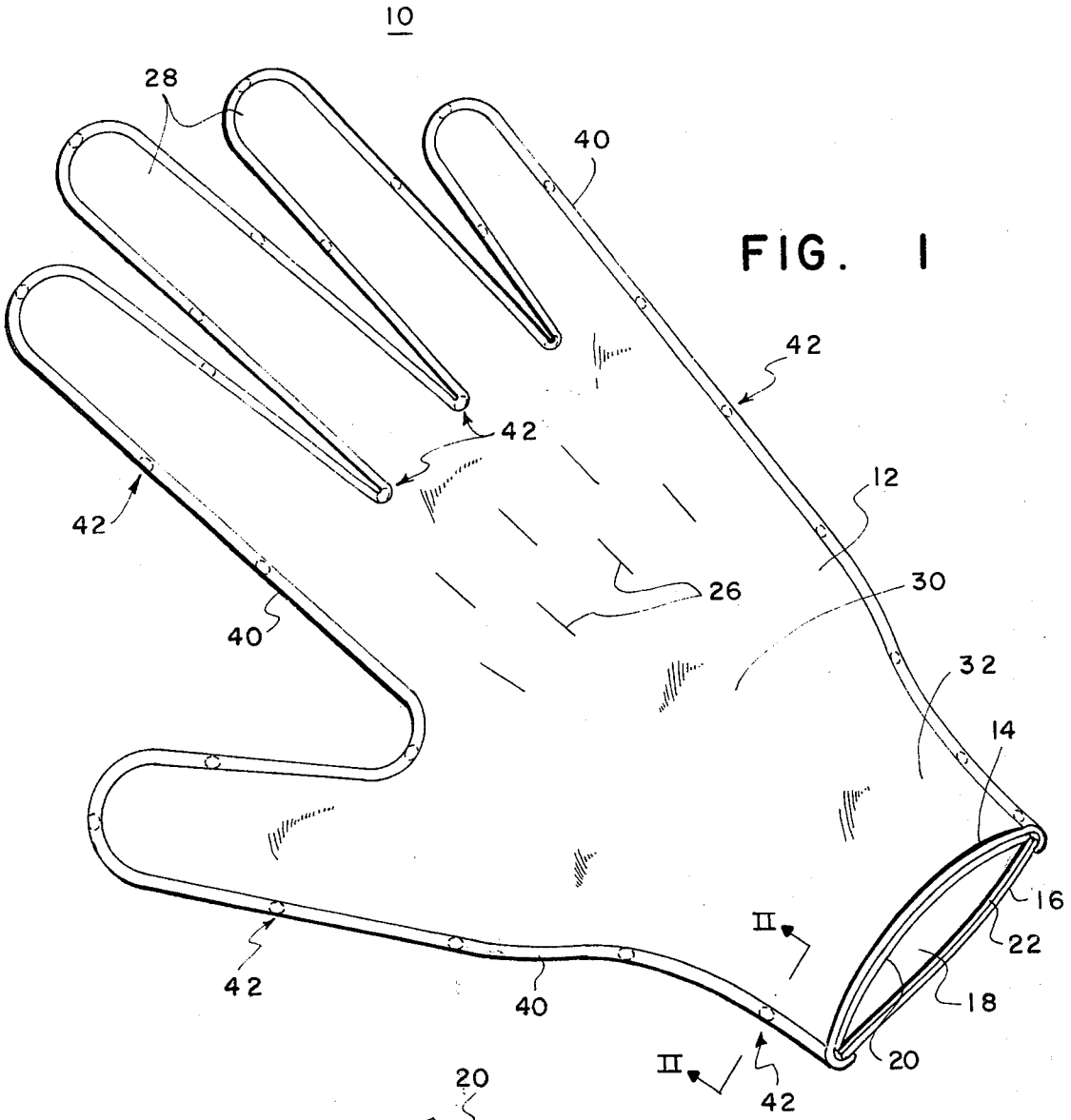
FIG. 1 is an isometric view of a glove constructed according to the teachings of the invention; and, FIG. 2 is a sectional view taken along the lines II-II of FIG. 1.

Referring now to the drawing, and in particular to FIG. 1 thereof, a preferred embodiment of the present invention comprises generally a disposable cosmetic glove 10 for continuously applying a cosmetic preparation such as a lotion or cream for cosmetic treatment of the hand. The glove 10 can be constructed in different sizes, for example large, medium and small, to accommodate hands of different dimensions.

The glove 10 comprises an outer glove shell 12 which is characterized by superposed first and second layers 14, 16 of a lotion impervious material. An inner glove lining 18 is disposed in nesting relation within the shell 12 intermediate the first and second impervious layers 14, 16. The lining 18 is characterized by superposed first and second lotion absorbent layers 20, 22 which are preferably uniformly impregnated with a cosmetic lotion 24. However, the glove 10 may be provided with the lining layers 20, 22 untreated thereby permitting a person to inject a lotion of personal choice into the lining prior to use. In connection with the use of the glove having an untreated lining, it is anticipated that the user will first thoroughly saturate her (or his) hands with lotion, and will also thoroughly saturate the interior of the lining 18 prior to use.

Various types of materials may be used to form the glove 10. For examples, materials such as vinyl, polyethylene or other suitable polymer materials may be used to form the outer glove shell 12. The outer glove shell 12 preferably comprises a lotion impervious, heat sealable material such as a film of thermoplastic resins, and in particular polyethylene, polypropylene, Mylar, nylon, vinyl resins such as polyvinylidne chloride, polyvinyl chloride, polyvinyl acetate and their mixtures or copolymers and the like film forming resins are suitable. Because of the lightweight, disposable nature of the glove, the thermoplastic film need only be 1-2 mils thick. Still other combinations of suitable materials for constructing the outer shell 12 would be a polyethylene coated paper or fabric substrate.

The inner lining layers 20, 22 are constructed from a lotion absorbent material such as an absorbent paper product, sponge, cloth or othr fiber substrate material such as tissue, towel, woven and non-woven fabrics, and the like.

An example of a suitable cosmetic preparation for impregnating the inner lining 18 is an aqueous emulsion of lanolin. Other cosmetic preparations such as glycerine or an oil phase lotion in combination with one or more emulsifying agents which upon the addition of moisture thereto will form a therapeutic cream may be used to good advantage. In that instance, the moisture required to form the cream will be provided by the wearer in the form of moisture and heat produced by the perspiration of the hands.

Figure 2:
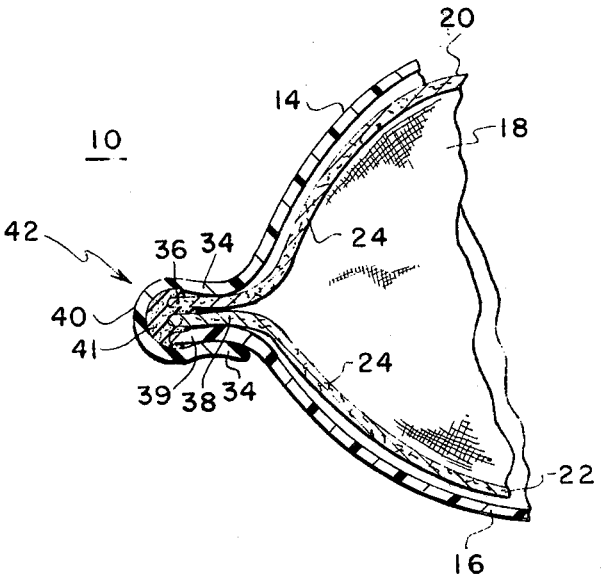

The cosmetic lotion is indicated generally at 24 in FIG. 2 of the drawing. When a cosmetic preparation such as an aqueous solution of lanolin is used, the outer shell 12 is preferably provided with a plurality of ventilation openings 26 which are preferably elongated slits as shown in FIG. 1 or may be circular openings. Several rows of openings 26 are provided in the outer shell 12 to assure proper ventilation of the hands. A pair of parallel rows of openings 26 are shown on the back side of the glove 12 which provides adequate ventilation without appreciably weakening the glove structure. Although the openings 26 are shown on the back of the glove, it should be understood that perforations or slits may also be formed on the under side or the reverse side of the glove, provided, however, adequate ventilation is provided without appreciably weakening the glove structure.

It will be observed that the glove 10 is equipped with individual finger coverings 28 and a hand enclosure portion 30 which is sufficiently large to completely envelop the hand. The glove 10 also includes a wrist portion 32 which converges to define a cuff which is preferably dimensioned to form a snug fit with the wrist to hold the glove onto the hand during the treatment period. It should be obvious that the finger enclosure portions 28 need not be articulated and a single enclosure portion may be provided in the form of a mitten or bootee.

The disposable feature of the glove depends substantially upon the use of relatively inexpensive materials for forming the outer shell 12 and the inner lining 18. The combination of thermoplastic materials for forming the outer shell 12 and the lotion absorbent fiber liner 18 is made practical by the edge bonding arrangement illustrated in FIG. 2 of the drawing. The glove 10 is fabricated generally by arranging the lining layers 20, 22 in superposed relation to each other between the thermoplastic layers 14, 16 which comprise the outer shell 12. The superposed layers are cut along a line which defines the periphery of the glove and the edges are then heat sealed together as shown in FIG. 2. According to that arrangement, an edge portion 34 of the thermoplastic layer 14 is folded around superposed edge portions 36, 38 of the lining layers 20, 22, respectively, and also around the edge 39 of the thermoplastic sheet 16. The layers are preferably pressed and heat sealed together to define a rim 40 which extends around the periphery of the glove. A suitable heat sealing process is disclosed in U.S. Pat. No. 3,384,083 which is hereby incorporated by reference.

A small amount of a thermosetting adhesive 41 is deposited at a number of selected locations 42 around the marginal edge of the glove. The adhesive may be applied before the lip 34 is folded, or it may be injected into the chamber defined by the lip 34 in combination with the terminal edge portions of the liner 18 after it has been folded. After the adhesive has been deposited, and the lip 34 has been folded into place, the marginal edge 40 is compressed and heat is applied causing the thermosetting adhesive 41 to bond the terminal edge portions 36, 38 to the surrounding thermoplastic lip portions 34, 39, and which also causes the lip 39 to be fused to the overlapping lip portion 34. This arrangement provides a continuous seal around the periphery of the glove, and the adhesive deposits 41 anchor the liner 18 to the sides of the glove to hold the liner in place as the glove is being worn.

The simple construction and assembly of the glove permit it to be produced in quantity by automatic machinery. The glove is preferably fabricated in a relatively sterile environment and is suitably packaged and hermetically sealed at the time of manufacture.

From the foregoing description, it will be seen that a very simple and effective isometric appliance has been provided for hand care treatment in a ne-time use, throw-away disposable glove. Because it is completely disposable, its use is convenient and sanitary. The primary function of the glove is to provide cosmetic hand care treatment by merely wearing the gloves. Although it is primarily intended to be worn during inactive periods such as while sleeping, it may also be worn and used to good advantage as an underglove while participating in activities in which the hands are likely to be chapped, for example while participating in cold weather sports such as skiing or ice skating; while driving; for wear under rubber gloves for protecting the hands when washing dishes; for wear in a beauty shop while drying hair; for softening cuticles; and for wear under work gloves while performing household cleaning tasks. The glove also has utility for medical applications in which the liner is impregnated with a medicated preparation for treatment of various dermatology problems or for treatment of burn trauma.

Although a preferred embodiment of the invention has been described in detail, it should be understood that various changes, substitutions, and alterations can be made therein without departing from the spirit and scope of the invention as defined by the appended claims.

What is claimed is:

1. A disposable cosmetic glove comprising, in combination, an outer glove shell characterized by superposed first and second layers of lotion impervious material, an inner glove lining disposed in nesting relation within the shell intermediate the first and second impervious layers, the lining being characterized by superposed first and second lotion absorbent layers, the shell and lining layers being sealed together along the marginal edge of the glove thereby defining a central hand receiving chamber; the lotion impervious layers being formed of thermoplastic material and the lotion absorbent layers being formed of fiber material, one of the thermoplastic layers being folded around the superposed marginal edge portions of the fiber layers and overlapping the other thermoplastic layer, the combination further including an adhesive deposit bonding the fiber layer edge portions to the thermoplastic edge portions, the overlapping thermoplastic edge portions being thermally fused together.

2. The cosmetic glove as defined in claim 1, wherein the first and second lotion absorbent layers are uniformly impregnated with a cosmetic lotion.

* * * * *

UNITED STATES PATENT OFFICE

CERTIFICATE OF CORRECTION

Patent No. 4,122,554 Dated October 31, 1978

Inventor(s) Phyllis H. Stager

It is certified that error appears in the above-identified patent and that said Letters Patent are hereby corrected as shown below:

| | |
|---|---|
| Column 1, line 22 | "sice" should be --since--. |
| Column 2, line 67 | "examples" should be --example--. |
| Column 3, line 15 | "othr" should be --other--. |
| Column 4, line 33 | "isometric" should be --cosmetic--. |
| Column 4, line 34 | "ne-time" should be --one-time--. |

Signed and Sealed this

*Seventeenth* Day of *July 1979*

[SEAL]

*Attest:*

*Attesting Officer*

LUTRELLE F. PARKER

*Acting Commissioner of Patents and Trademarks*